United States Patent [19]

Blauschild

[11] Patent Number: 4,851,759

[45] Date of Patent: Jul. 25, 1989

[54] UNITY-GAIN CURRENT-LIMITING CIRCUIT

[75] Inventor: Robert A. Blauschild, Los Altos, Calif.

[73] Assignee: North American Philips Corporation, Signetics Division, Sunnyvale, Calif.

[21] Appl. No.: 199,063

[22] Filed: May 26, 1988

[51] Int. Cl.[4] ..... G05F 1/613

[52] U.S. Cl. ..... 323/223; 323/303; 323/312; 323/908; 361/87

[58] Field of Search ..... 323/223, 226, 299, 303, 323/311, 312, 908; 361/87, 93

[56] References Cited

U.S. PATENT DOCUMENTS

| | | | |
|---|---|---|---|
| 4,219,744 | 8/1980 | Shinn | 307/290 |
| 4,567,537 | 1/1986 | Kalkhof et al. | 323/312 |
| 4,709,163 | 11/1987 | Kasperkovitz | 323/312 |
| 4,727,309 | 2/1988 | Vajdic et al. | 323/312 |
| 4,744,369 | 5/1988 | Kroll | 323/908 |

FOREIGN PATENT DOCUMENTS 0100177 2/1984 European Pat. Off. .

OTHER PUBLICATIONS

Soclof, *Application of Analog Integrated Circuits* (Prentice-Hall: 1985), pp. 35–42.

*Primary Examiner*—Patrick R. Salce
*Assistant Examiner*—Jeffrey Sterrett
*Attorney, Agent, or Firm*—R. Meetin; D. Treacy; T. Briody

[57] ABSTRACT

A highly accurate current-limiting circuit prevents an output current ($I_{OUT}$) flowing through an output line ($L_{OUT}$) from exceeding a specified value ($I_{LIM}$) of an input current ($I_{IN}$) flowing through an input line ($L_{IN}$). The circuit contains a first channel device (10) controlled by a first reference voltage ($V_{REF1}$), a current source (12) that supplies a reference current ($I_{REF}$), a second channel device (14) controlled by a second reference voltage ($V_{REF2}$), a current bypass device (16), and a bypass control system (18). The current gain below the specified value of the input current is close to one. By suitably choosing certain of the circuit parameters, the circuit operates in a substantially temperature-independent manner.

20 Claims, 2 Drawing Sheets

UNITY-GAIN CURRENT-LIMITING CIRCUIT

FIELD OF USE

This invention relates to electronic circuits suitable for use in semiconductor devices and, more particularly, to circuits that limit the maximum value of a current.

BACKGROUND ART

Current-limiting circuitry is employed in many semiconductor devices to conserve power or to achieve a predetermined maximum output current for a variable input current. For example, Soclof, *Applications of Analog Integrated Circuits* (Prentice-Hall: 1985), pp. 3--42, describes how voltage regulators use current-limiting circuits to avoid excessive power dissipation that could lead to overheating and permanent damage. The current limiters in Soclof provide a current gain that is much greater than unity at values of the input current below which significant current limiting occurs.

A current-limiting circuit that achieves a current gain largely equal to one is desirable in certain applications. In such a device, the output current ideally equals the input current up to a specified value of the input current above which the output current is fixed at the specified value of the input current. Designing a simple unity-gain circuit that comes close to the ideal current transfer characteristic presents a significant challenge. It is often desirable that the circuit operate in a largely temperature-independent manner. This increases the challenge considerably.

GENERAL DISCLOSURE OF THE INVENTION

The present invention is a highly accurate current-limiting circuit that prevents an output current flowing through an output line from exceeding a specified value of an input current flowing through an input line. The current gain below the specified value of the input current is very close to unity. The circuit is formed with a main current channel, a current source, a reference current channel, a bypass device, and a bypass control system.

The main channel provides a current path between the output line and an intermediate line coupled to the input line by way of a first node at which a first nodal voltage is present. The intermediate line carries an intermediate current largely equal to the output current. The main channel preferably contains a first channel device that causes the output current to vary in a prescribed way as a function of the first nodal voltage and a first reference voltage. The output current usually increases as the magnitude of the difference between the two voltages increases.

The current source, which is coupled between a first voltage supply and a second node at which a second nodal voltage is present, supplies a reference current. The reference channel provides a current path between the second node and a second voltage supply. The reference channel preferably contains a second channel device that largely sets the second nodal voltage at a value dependent on the reference current and a second reference voltage.

The bypass device is coupled to the first node to provide a current shunt away from the main channel. The control system, which is coupled to the two nodes, supplies the bypass device with a control signal that causes a portion of the input current to be diverted away from the intermediate line and through the bypass device when the input current achieves a prescribed relationship to the reference current. As the input current increases, the diverted current portion progressively increases in such a way that the output current does not pass the specified value of the input current.

More specifically, the control signal switches between a pair of opposite voltage states depending on the amount of difference between the nodal voltages. Generation of the control signal at one of the states disables the bypass device so that none of the input current flows through it. The output current largely equals the input current. Generation of the control signal at the other state enables the bypass device so as to permit the requisite portion of the input current to flow through it. The control system is usually implemented with a differential amplifier and a positive feedback device in order to produce a sharp transition between the unity-gain and current-limited conditions.

The first channel device is preferably formed with a first bipolar transistor having a base responsive to the first reference voltage, an emitter coupled through a first resistor to the intermediate line, and a collector coupled to the output line. The second channel device is then likewise formed with a like-polarity second bipolar transistor having a base responsive to the second reference voltage, an emitter coupled through a second resistor to the second node, and a collector coupled to the second voltage supply. The two reference voltages are typically the same. In this case, the circuit can be made to operate in a substantially temperature-independent manner by setting the ratio of the value of the second resistor to the value of the first resistor equal to the ratio of the emitter area of the first transistor to the emitter area of the second transistor.

BRIEF DESCRIPTION OF THE DRAWINGS

Like reference symbols are employed in the drawings and in the description of the preferred embodiments to represent the same or very similar item or items. The arrows in FIGS. 1, 3, and 4 indicate the directions of positive current flow.

DESCRIPTION OF THE PREFERRED EMBODIMENTS

Figure 1:
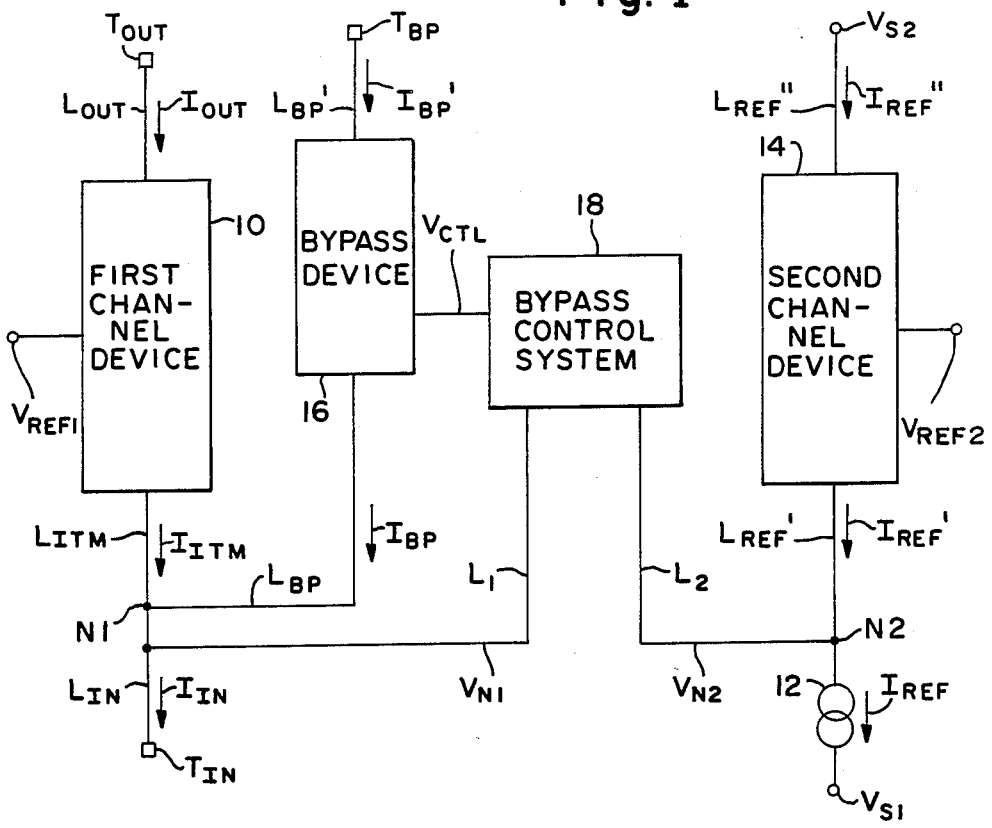
FIG. 1 is a block diagram of a unity-gain current-limiting circuit in accordance with the invention.

Referring to the drawings, FIG. 1 illustrates the basic features of a current-limiting circuit configured according to the teachings of the invention. The circuit prevents an output current $I_{OUT}$ from exceeding a specified value $I_{LIM}$ of an input current $I_{IN}$. Output current $I_{OUT}$ flows through an input line $L_{OUT}$ connected to a circuit output terminal $T_{OUT}$. Input current $I_{IN}$ similarly flows through an input line $L_{IN}$ connected to a circuit input terminal $T_{IN}$.

The circuit in FIG. 1 is connected between a source of a first supply voltage $V_{S1}$ and a source of a second supply voltage $V_{S2}$. The $V_{S1}$ and $V_{S2}$ supplies provide operating power to the circuit. The principal components of the circuit are a first channel device 10 controlled by a fixed first reference votage $V_{REF1}$, a current source 12 that supplies a reference current $I_{REF}$, a second channel device 14 controlled by a fixed second reference voltage $V_{REF2}$, a current bypass device 16, and a bypass control system 18.

Channel device 10 provides a current path between output line $L_{OUT}$ and an intermediate line $L_{ITM}$ connected through a first node N1 to input line $L_{IN}$. An intermediate current $I_{ITM}$ flows on intermediate line $L_{ITM}$. The current path through device 10 is of such a nature that current $I_{ITM}$ is largely equal to current $I_{OUT}$. $I_{ITM}$ is preferably within 5% of $I_{OUT}$ and typically differs from $I_{OUT}$ by 1% or less. The combination of line $L_{ITM}$, device 10, and line $L_{OUT}$ thereby forms a main channel for current $I_{OUT}$.

A first nodal voltage $V_{N1}$ is present at node N1. Current $I_{OUT}$ depends strongly on voltage $V_{N1}$. More precisely, channel device 10 causes current $I_{OUT}$ to vary in a prescribed manner as a function of voltages $V_{N1}$ and $V_{REF1}$. The relationship among these parameters usually has the characteristic that $I_{OUT}$ increases as the magnitude of the voltage difference between $V_{N1}$ and $V_{REF1}$ increases.

Current source 12 is connected between the $V_{S1}$ supply and a second node N2. A second nodal voltage $V_{N2}$ is present at node N2. Source 12 is typically implemented in such a manner that current $I_{REF}$ is substantially independent of temperature and the overall power supply voltage $|V_{S2}-V_{S1}|$. However, $I_{REF}$ can be made to vary with either or both of these parameters.

Channel device 14 is part of a reference channel that provides a current path between node N2 and the $V_{S2}$ supply. The remainder of the reference channel consists of interconnecting lines $L_{REF}'$ and $L_{REF}''$ which carry respective largely equal currents $I_{REF}'$ and $I_{REF}''$. The difference between $I_{REF}'$ and $I_{REF}''$ is preferably no more than 5% and is typically 1% or less. For the reason given below, current $I_{REF}'$ is substantially equal to reference current $I_{REF}$ supplied by current source 12. This enables device 14 to set voltage $V_{N2}$ at a value dependent on current $I_{REF}$ and voltage $V_{REF2}$.

Bypass device 16 provides a shunt for selectively diverting a portion of current $I_{IN}$ away from the main channel and through a circuit bypass terminal $T_{BP}$. Lines $L_{BP}$ and $L_{BP}'$ connect device 16 respectively to node N1 and terminal $T_{BP}$. When device 16 is enabled (or activated), largely equal bypass currents $I_{BP}$ and $I_{BP}'$ flow respectively on lines $L_{BP}$ and $L_{BP}'$. Currents $I_{BP}$ and $I_{BP}'$ represent the diverted portion of current $I_{IN}$. $I_{BP}'$ is preferably within 5% of $I_{BP}$ and typically differs from $I_{BP}$ by 1% or less. Device 16 performs the current shunting when current $I_{IN}$ achieves a prescribed relationship to current $I_{REF}$. For example, if channel devices 10 and 14 are substantially identical, shunting occurs when $I_{IN}$ is greater than $I_{REF}$.

Control ssytem 18 supplies device 16 with a control signal $V_{CTL}$ that regulates the shunting. Control signal $V_{CTL}$ switches between a pair of opposite voltage states, referred to here as the high and low states, depending on the amount (i.e., the magnitude and sign) of the difference between voltages $V_{N1}$ and $V_{N2}$. The shunting is initiated when signal $V_{CTL}$ goes to the high state and is terminated when signal $V_{CTL}$ returns to the low state. The high state may represent either a high voltage condition or a low voltage condition depending on whether $V_{S2}$ is greater than or less than $V_{S1}$. Similar comments apply to the low state.

Voltages $V_{N1}$ and $V_{N2}$ are supplied to control system 18 from nodes N1 and N2 by way of lines $L_1$ and $L_2$ that carry bias currents much smaller than currents $I_{REF}$ and $I_{LIM}$. It is for this reason that $I_{REF}'$ is substantially equal to $I_{REF}$. During the time that signal $V_{CTL}$ is at the high state (so as to enable bypass device 16), control system 18 receives negative feedback from device 16 by way of lines $L_{BP}$ and $L_1$. System 18 operates in such a way that the negative feedback prevents the magnitude of the difference between voltages $V_{N1}$ and $V_{N2}$ from becoming very large.

Figure 2:
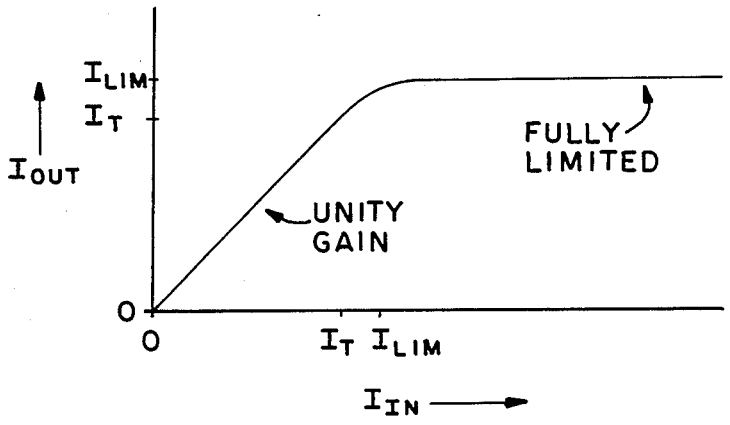
FIG. 2 is a graph for output current as a function of input current for the circuit in FIG. 1.

With the foregoing in mind, the circuit components interact as follows to accomplish the current-limiting function. Let "$I_T$" represent the value of current $I_{IN}$ at which shunting begins. Assume (for example) that $V_{S2}$ is greater than $V_{S1}$. The various currents then flow in the directions indicated in FIG. 1. FIG. 2 shows how $I_{OUT}$ varies with $I_{IN}$.

If $I_{IN}$ is below $I_T$, $V_{N1}$ is greater than $V_{N2}$. In response, control system 18 supplies signal $V_{CTL}$ at a value that falls into a voltage range representing the low state. This disables (or deactivates) bypass device 16. Substantially none of $I_{IN}$ flows through device 16. Neglecting the small bias current on line $L_1$, $I_{ITM}$ is substantially equal to $I_{IN}$. Current $I_{OUT}$ thus largely equals $I_{IN}$. See the left half of FIG. 2. The current gain—i.e., $I_{OUT}/I_{IN}$—is very close to one.

Increasing $I_{IN}$ causes $I_{OUT}$ to increase. Channel device 10 reduces $V_{N1}$ in response to the increase in $I_{OUT}$. $V_{N1}$ drops to a value close to $V_{N2}$ when $I_{IN}$ reaches transition value $I_T$. $V_{N1}$ may be slightly greater than or slightly less than $V_{N2}$ at this point depending on the internal construction of control system 18. The magnitude of the voltage difference between $V_{N1}$ and $V_{N2}$ is usually no more than 60 millivolts when $I_{IN}$ equals $I_T$.

A slight further increase in $I_{IN}$ and a consequent slight further decrease in $V_{N1}$ causes control system 18 to produce signal $V_{CTL}$ at a value falling into a voltage range representing the high state. Bypass device 16 becomes active. This allows (non-zero) portion $I_{BP}$ of current $I_{IN}$ to be diverted away from line $L_{ITM}$ and along line $L_{BP}$ through device 16.

As $I_{IN}$ continues to increase beyond $I_T$, $I_{BP}$ progressively increases in such a way that $I_{OUT}$ does not pass limiting value $I_{LIM}$. More particularly, the manner in which components 16 and 18 are arranged allows $I_{BP}$ to change by a relatively large amount in response to a small change in the difference between $V_{N1}$ and $V_{N2}$. The negative feedback through device 16 controls the difference between $V_{N1}$ and $V_{N2}$. (Interaction between control system 18 and channel device 14 typically causes $V_{N2}$ to rise slightly). In turn, device 10 prevents current $I_{OUT}$ from passing $I_{LIM}$. The resulting current profile is shown in the right half of FIG. 2.

The sharpness of the transition between the unity-gain and fully-limited conditions is essentially represented by the difference between $I_T$ and $I_{LIM}$. This difference is, in turn, determined principally by the gain of the transfer function through components 18 and 16. Using relatively simple configurations for components 16 and 18, the difference between $I_T$ and $I_{LIM}$ can be 5% or less to give a sharp transfer curve.

Figure 3:
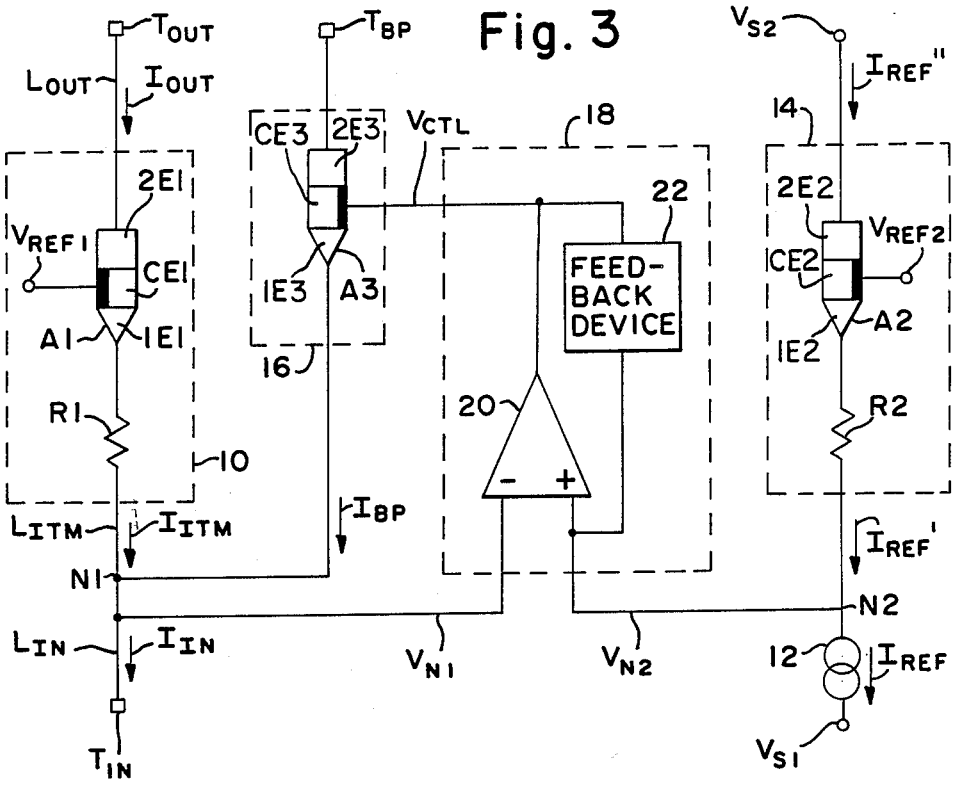
FIG. 3 is a circuit diagram for a general implementation of the circuit in FIG. 1.

Turning to FIG. 3, it shows internal details for a general embodiment of the current-limiting circuit in FIG. 1. The embodiment in FIG. 3 uses several three-electrode amplifiers identified by reference symbols beginning with the letter "A". Each such Ai amplifier has a first flow electrode 1Ei, a second flow electrode 2Ei, and a control electrode CEi for controlling current flow between electrodes 1Ei and 2Ei, where i is a running integer. Charge carriers, either electrons or holes, that move between the flow electrodes of each Ai amplifier originate at its first flow electrode and terminate at its second flow electrode. The current (if any) flowing in the control electrode is much smaller than that otherwise moving between the flow electrodes.

Each Ai amplifier is typically a single transistor. In the case of a bipolar transistor, its emitter, collector, and base are respectively the first, second, and control electrodes. These are the source, drain, and gate, respectively, for a field-effect transistor of either the insulated-gate or junction type.

Each "A" amplifier Ai could, however, be formed with more electronic elements than just a single transistor. One example is a bipolar Darlington circuit in which the emitter of an input transistor drives the base of a trailing transistor. In this example, control electrode of the Ai amplifier is (connected to) the base of the input transistor, while the first and second electrodes are (connected to) the emitter and collector of the trailing transistor.

Certain of Ai amplifiers are "like-configured". This means that they have corresponding elements interconnected in the same way and that each set of corresponding elements is of the same semiconductor polarity. For example, two of amplifiers Ai are like-configured if both are NPN transistors (even though the emitter areas are different), but not if they are complementary transistors. Likewise two Darlington circuits are like-configured as long as the input transistors are of the same polarity and the trailing transistors are of the same polarity even if it is different from that of the input transistors.

Channel devices 10 and 14 in FIG. 3 respectively center around like-configured three-electrode (always-on) amplifiers A1 and A2 whose control electrodes are respectively responsive to voltages $V_{REF1}$ and $V_{REF2}$. The first and second electrodes of amplifier A1 are respectively coupled to lines $L_{ITM}$ and $L_{OUT}$. The first and second electrodes of amplifier A2 are respectively coupled to node N2 and the $V_{S2}$ supply. Device 10 may have a first resistor R1 connected between node N1 and the first electrode of amplifier A1. If so, device 14 has a second resistor R2 connected between node N2 and the first electrode of amplifier A2.

Bypass device 16 is formed with a three-electrode switching amplifier A3 whose control electrode is responsive to signal $V_{CTL}$. Amplifier A3 has its first and second electrodes respectively connected to node N1 and terminal $T_{BP}$. Amplifier A3 turns on when signal $V_{CTL}$ goes to the high state, and vice versa.

Control system 18 consists of a differential amplifier 20 and a feedback device 22. Differential amplifier 20 supplies signal $V_{CTL}$ from a node N3 at its output by amplifying the difference between voltages $V_{N1}$ and $V_{N2}$ respectively supplied to its inverting and non-inverting inputs. Device 22 provides positive feedback from the output of amplifier 20 to its non-inverting input. The positive feedback increases the gain of system 18. In turn, this reduces the magnitude of the difference between voltages $V_{N1}$ and $V_{N2}$ at the fully limited condition.

Figure 4:
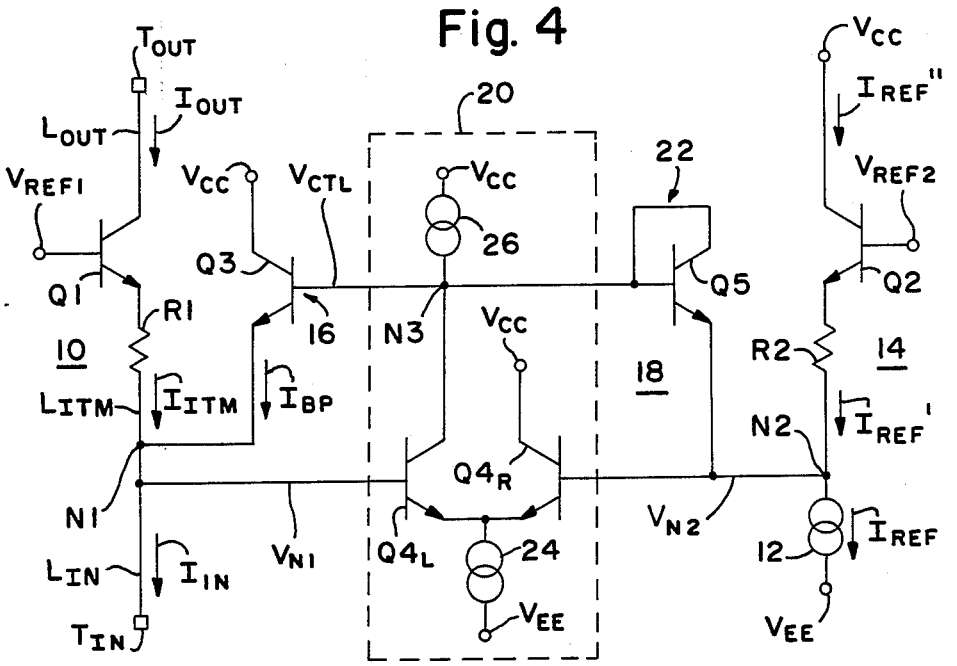
FIG. 4 is a circuit diagram for a preferred embodiment of the circuit in FIG. 3.

FIG. 4 illustrates a preferred bipolar implementation for the circuit of FIG. 3. Voltages $V_{S1}$ and $V_{S2}$ are low and high supply voltages $V_{EE}$ and $V_{CC}$ in FIG. 4. Terminal $T_{BP}$ is connected to the $V_{CC}$ supply. The current-limiting circuit is typically part of a monolithic semiconductor integrated circuit.

Amplifiers A1 and A2 and devices 10 and 14 of FIG. 4 are respectively formed with NPN transistors Q1 and Q2. Devices 10 and 14 also include resistors R1 and R2 in FIG. 4. Device 16 is implemented with an NPN transistor Q3.

Differential amplifier 20 centers around largely identical NPN transistors $Q4_L$ and $Q4_R$ whose bases receive voltages $V_{N1}$ and $V_{N2}$. A current source 24 is connected between the $V_{EE}$ supply and the interconnected emitters of transistors $Q4_L$ and $Q4_R$. Their collectors are respectively connected to node N3 and the $V_{CC}$ supply. Another current source 26 is connected between node N3 and the $V_{CC}$ supply. Amplifier 20 operates in a conventional manner.

Feedback device 22 consists of a PN-junction diode whose anode and cathode are respectively connected to nodes N3 and N2. The diode is preferably an NPN transistor Q5 having its collector tied back to its base. When signal $V_{CTL}$ goes to the high state, transistor Q5 turns on largely in synchronism with transistor Q3. The positive feedback through transistor Q5 causes $V_{N2}$ to rise slightly due to interaction with transistor Q2.

The following relationships respectively define the operation of devices 10 and 14:

$$V_{REF1}-V_{BE1}-R_1I_{ITM}=V_{N1} \quad (1)$$

$$V_{REF2}-V_{BE2}-R_2I_{REF}'=V_{N2} \quad (2)$$

$V_{BE1}$ and $V_{BE2}$ are the respective base-to-emitter voltages of transistors Q1 and Q2. $R_1$ and $R_2$ are the respective resistances of resistors R1 and R2.

The base-to-emitter voltage of an NPN transistor approximately equals kT/q multiplied by the natural logarithm of the collector current divided by the transistor saturation current, where k is Boltzmann's constant, T is the absolute temperature, and q is the electronic charge. Taking note of this along with the approximate current equalities discussed above for FIG. 1, Eqs. (1) and (2) can be converted into:

$$R_1I_{OUT}+(kT/q)\ln(I_{OUT}/I_{S1})\approx V_{REF1}-V_{N1} \quad (3)$$

$$V_{NS}\approx V_{REF2}-R_2I_{REF}-(kT/q)\ln(I_{REF}/I_{S2}) \quad (4)$$

$I_{S1}$ and $I_{S2}$ are the respective saturation currents for transistors Q1 and Q2. Eq. (3) shows that $I_{OUT}$ increases as the magnitude of the difference between $V_{REF1}$ and $V_{N1}$ increases. Eq. (4) demonstrates how $V_{N2}$ can be calculated as a function of $V_{REF2}$ and $I_{REF}$.

As mentioned above, $I_{IN}$ equals $I_T$ when $V_{N1}$ is nearly equal to $V_{N2}$. Since $I_{OUT}$ largely equals $I_{IN}$ at that point, Eqs. (3) and (4) can be combined to give the following relationship for the transition point:

$$I_T^{\circ}(kT/qR_1)\ln(I_{S2}I_T/I_{S1}I_{REF})\approx(R_2/R_1)I_{REF}+(-V_{REF1}-V_{REF2})/R_1 \quad (5)$$

$V_{REF2}$ preferably equals $V_{REF1}$. In addition, the saturation current ratio $I_{S2}/I_{S1}$ substantially equals the emitter area ratio $A_{E2}/A_{E1}$, where $A_{E1}$ and $A_{E2}$ are the respective emitter areas of transistors Q1 and Q2. Eq. (5) reduces to:

$$I_T+(kT/qR_1)\ln(A_{E2}I_T/A_{E1}I_{REF})\ (0R_2/R_1)I_{REF} \quad (6)$$

It is usually desirable that the invention be substantially insensitive to changes in temperature. This is achieved in FIG. 4 by choosing the values of circuit parameters in such a way that the parenthetical portion of the logarithmic term in Eq. (6) equals one so that the logarithmic term equals zero. As a result:

$$I_T/I_{REF}=A_{E1}/A_{E2}\approx R_2/R_1 \quad (7)$$

Resistances $R_1$ and $R_2$ vary with temperature. However, the temperature dependencies largely "cancel out" in the ratio $R_2/R_1$. Eq. (7) thereby establishes the conditions that enable the circuit in FIG. 4 to operate in a substantially temperature independent manner.

In the preferred embodiment, $V_{EE}$ and $V_{CC}$ are nominally 0 and 5 volts. $V_{REF1}$ and $V_{REF2}$ are both 2.5 volts. $R_1$ and $R_2$ are both 1,000 ohms. $A_{E2}$ equals $A_{E1}$. $I_{REF}$ is 200 microamperes. $I_T$ and $I_{LIM}$ are about 210 and 220 microamperes. Differential amplifier 20 has a gain of approximately 1,000.

While the invention has been described with reference to particular embodiments, this description is solely for the purpose of illustration and is not to be construed as limiting the scope of the invention claimed before. For example, semiconductor elements of opposite polarity to those described above may be used to achieve the same results. Temperature compensation similar to that described above can be achieved when the invention is implemented with field-effect transistors. Various modifications and applications may be thus made by those skilled in the art without departing from the true scope and spirit of the invention as defined in the appended claims.

I claim:

1. An electronic circuit for preventing an output current flowing through an output line from exceeding a specified value of an input current flowing through an input line, characterized by:

a main channel, including the output line and an intermediate line coupled to the input line by way of a first node at which a first nodal voltage is present, for providing a current path between the intermediate and output lines, the intermediate line carrying a current largely equal to the output current;

a current source, coupled between a first voltage supply and a second node at which a second nodal voltage is present, for supplying a reference current;

a reference channel for providing a current path between the second node and a second voltage supply;

bypass means coupled to the first node for providing a current shunt away from the main channel; and control means coupled to the nodes for supplying the bypass means with a control signal that causes a portion of the input current to be diverted away from the intermediate line and through the bypass means when the input current achieves a prescribed relationship to the reference current, the diverted current portion progressively increasing as the input current increases such that the output current does not pass the specified value of the input current.

2. A circuit as in claim 1 characterized in that:

the main channel comprises a first channel device that causes the output current to vary in a prescribed way as a function of the first nodal voltage and a first reference voltage;

the reference channel comprises a second channel device that largely sets the second nodal voltage at a value dependent on the reference current and a second reference voltage; and the control signal switches between a pair of opposite states depending on the amount of difference between the nodal voltages.

3. A circuit as in claim 2 characterized in that the output current increases as the magnitude of the difference between the first nodal voltage and the first reference voltage increases.

4. A circuit as in claim 2 characterized in that generation of the control signal at a selected one of the states causes the bypass means to be disabled, substantially none of the input current flowing through the bypass means when it is disabled.

5. A circuit as in claim 2 characterized in that:

the first channel device comprises a first amplifier having a first flow electrode coupled to the intermediate line, a second flow electrode coupled to the output line, and a control electrode responsive to the first reference voltage for controlling current flow between the flow electrodes of the first amplifier; and the second channel device comprises a second amplifier having a first flow electrode coupled to the second node, a second flow electrode coupled to the second voltage supply, and a control electrode responsive to the second reference voltage for controlling current flow between the flow electrodes of the second amplifier.

6. A circuit as in claim 5 characterized in that:

the first channel device includes a first resistor coupled between the intermediate line and the first electrode of the first amplifier; and the second channel device includes a second resistor coupled between the second node and the first electrode of the second amplifier.

7. A circuit as in claim 6 characterized in that the first and second amplifiers respectively comprise first and second like-polarity bipolar transistors, each having an emitter, a collector, and a base respectively coupled to the first, second, and control electrodes of its amplifier.

8. A circuit as in claim 7 characterized in that: the reference voltages are substantially the same; and $R_2/R_1$ is largely equal to $A_{E1}/A_{E2}$, where $R_1$ *l and R2* are the respective resistances of the first and second resistors, and $A_{E1}$ and $A_{E2}$ are the respective areas of the emitters of the first and second transistors.

9. A circuit as in claim 5 characterized in that the control means comprises a differential amplifier having an inverting input for receiving the first nodal voltage, a non-inverting input for receiving the second nodal voltage, and an output for supplying the control signal as an amplification of the difference between the nodal voltages.

10. A circuit as in claim 9 characterized in that the control means includes feedback means for providing positive feedback from the output of the differential amplifier to its non-inverting input.

11. A circuit as in claim 9 characterized in that the bypass means comprises a further amplifier having a first flow electrode coupled to the first node, a second flow electrode coupled to the second voltage supply, and a control electrode responsive to the control signal for controlling current flow between the flow electrodes of the further amplifier.

12. A circuit as in claim 11 characterized in that:

the first channel device includes a first resistor coupled between the intermediate line and the first electrode of the first amplifier; and the second channel device includes a second resistor coupled between the second node and the first electrode of the second amplifier.

13. A circuit as in claim 12 characterized in that the first and second amplifiers respectively comprise first and second like-polarity bipolar transistors, each having an emitter, a collector, and a base respectively coupled to the first, second, and control electrodes of its amplifier.

14. A circuit as in claim 13 characterized in that the control means includes feedback means for providing positive feedback from the output of the differential amplifier to its non-inverting input.

15. A circuit as in claim 14 characterized in that: the reference voltages are substantially the same; and $R_2/R_1$ is largely equal to $A_{E1}/A_{E2}$, where $R_1$ and $R_2$ are the respective resistances of the first and second resistors, and $A_{E1}$ and $A_{E2}$ are the respective areas of the emitters of the first and second transistors.

16. A circuit as in claim 15 characterized in that the transistors are NPN transistors.

17. A circuit as in claim 9 characterized in that the bypass means comprises a diode coupled between the first node and the output of the differential amplifier.

18. A circuit as in claim 17 characterized in that the diode is a base-emitter junction of a bipolar transistor having a collector coupled to the second voltage supply.

19. An electronic circuit for preventing an output current flowing through an output line from exceeding a specified value of an input current flowing through an input line, characterized by:

a first amplifier having a first flow electrode coupled to an intermediate line, a second flow electrode coupled to the output line, and a control electrode responsive to a first reference voltage for regulating current transmission between the flow electrodes of the first amplifier, the intermediate line carrying an intermediate current largely equal to the output current, the input line being coupled to the intermediate line by way of a first node at which a first nodal voltage is present;

a current source, coupled between a first voltage supply and a second node at which a second nodal voltage is present, for supplying a reference current;

a second amplifier having a first flow electrode coupled to the second node, a second flow electrode coupled to a second voltage supply, and a control electrode responsive to a second reference voltage for regulating current transmission between the flow electrodes of the second amplifier, the amplifiers being like-configured;

bypass means coupled to the first node for providing a current shunt away from the main channel; and control means coupled to the nodes for supplying the bypass means with a control signal that causes a portion of the input current to be diverted away from the intermediate line and through the bypass means when the input current achieves a prescribed relationship to the reference current, the diverted current portion progressively increasing as the input current increases such that the output current does not pass the specified value of the input current.

20. A circuit as in claim 19 characterized by:

a first resistor coupled between the intermediate line and the first electrode of the first amplifier; and a second resistor coupled between the second node and the first electrode of the second amplifier.

* * * * *